United States Patent [19]

Wisser

[11] Patent Number: 4,534,701

[45] Date of Patent: Aug. 13, 1985

[54] ROTOR OR GUIDE WHEEL OF A TURBINE ENGINE WITH SHROUD RING

[76] Inventor: Gerhard Wisser, Grubweg 11, 7745 Schonach, Fed. Rep. of Germany

[21] Appl. No.: 508,724

[22] Filed: Jun. 28, 1983

[30] Foreign Application Priority Data

Jun. 29, 1982 [DE] Fed. Rep. of Germany ..... 3225280

[51] Int. Cl.[3] ..... F04D 29/68; F01D 11/02

[52] U.S. Cl. ..... 415/168; 415/DIG. 1; 416/181

[58] Field of Search ..... 416/181, 189; 415/115, 415/172 A, 176, DIG. 1, 144, 168

[56] References Cited

U.S. PATENT DOCUMENTS

| | | | |
|---|---|---|---|
| 2,291,828 | 8/1942 | New | 415/115 |
| 3,846,038 | 11/1974 | Carriere et al. | 416/181 |
| 3,876,330 | 4/1975 | Pearson et al. | 416/189 |
| 3,980,411 | 9/1976 | Crow | 415/115 |

FOREIGN PATENT DOCUMENTS

| | | | |
|---|---|---|---|
| 146201 | 11/1980 | Japan | 416/181 |
| 408057 | 5/1974 | U.S.S.R. | 416/181 |
| 663861 | 5/1979 | U.S.S.R. | 416/181 |

*Primary Examiner*—Robert E. Garrett
*Assistant Examiner*—Joseph M. Pitko
*Attorney, Agent, or Firm*—Leonard Bloom

[57] ABSTRACT

In rotors and guide wheels of a turbine engine which are equipped with a shroud ring, at least one opening (26, 28) is provided in the shroud ring (12) in the vicinity of the compression side (A) of each turbine blade (10) in accordance with the invention, in order to reduce gap and peripheral losses. As a result of the prevailing pressure difference, a portion of the flow medium is blown out of the blade channel through these openings into the chamber (22) formed between the sealing combs (16, 18) of the labyrinth seal; this portion would otherwise result in the known problem of peripheral losses in the blade channel. The pressure compensation thus attained between the space preceding the cascade and the chamber (22) blocks off the leakage flow about the outer rim of the shroud ring (12) and thereby precludes the known problem of gap losses as well.

5 Claims, 4 Drawing Figures

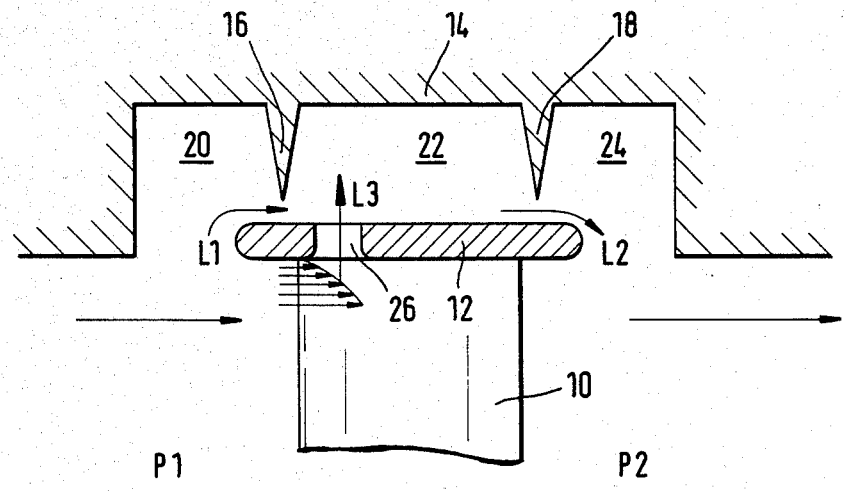
FIG. 2
FIG. 1
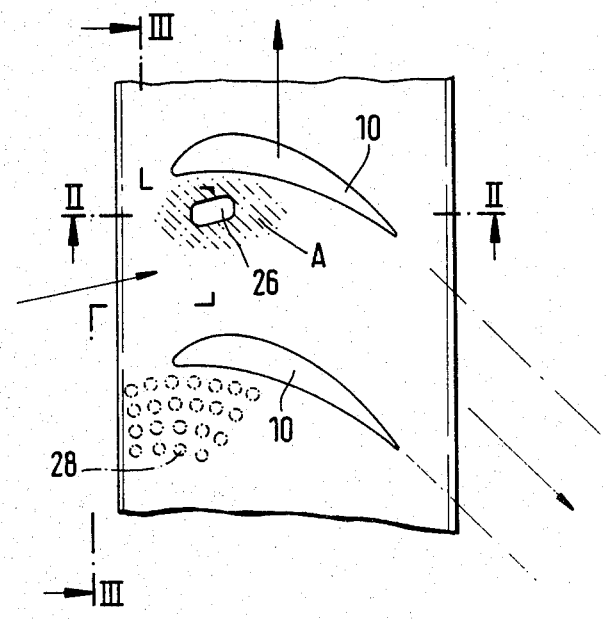
FIG. 3
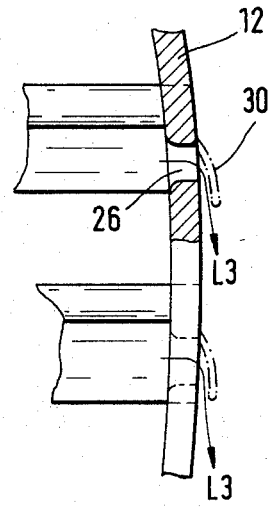

ROTOR OR GUIDE WHEEL OF A TURBINE ENGINE WITH SHROUD RING

BACKGROUND OF THE INVENTION

The invention relates to a rotor or guide wheel of a turbine engine which is equipped with a shroud ring.

In turbine wheels of this general type, the boundary layer of the flow which forms along the side of the shroud ring oriented toward the blade channel experiences a pressure in the vicinity of the compression side of the blades which is approximately equal to the total inlet pressure preceding the cascade. The medium flowing into this boundary layer is braked there and is set into motion in the direction toward the intake side by the pressure drop in the blade channel directed from the compression side toward the intake side. The result is a secondary flow in the blade channel, which leads to the known problem of secondary or peripheral losses.

As a result of the same pressure drop which produces the pressure differences in the blade channel, a portion of the medium is also removed by suction via the outer side of the shroud ring through the gaps between the sealing combs of the labyrinth seal and the outer surface of the shroud ring. This second leakage flow leads to the known problem of gap losses.

In both cases, the diverted medium has a disadvantageous effect on the internal efficiency of the turbine engine.

OBJECT AND SUMMARY OF THE INVENTION

It is accordingly the object of the invention to preclude the secondary flows in the blade channel and the leakage flow outside the shroud ring, thus eliminating or reducing to a minimum the peripheral and gap losses.

This object is attained in accordance with the invention in that at least one opening is provided in the shroud ring in the vicinity of the compression side of each turbine blade; this is accomplished by making the blade channel communicate with the space between the sealing combs of the labyrinth seal. The flowing medium which is braked in the wall boundary layer near the compression side of the blade channel is drawn by suction through these openings in the shroud ring into the space in the labyrinth seal located outside the blade channel, because the pressure gradient in this suction direction is greater than in the direction of the secondary flow. Thus the leakage flow via the shroud ring is interrupted, and as a result not only is the loss at the periphery of the cascade reduced, but also the gap loss is eliminated or reduced to a minimum. The result is a substantial improvement, which is attainable with simple means, in the efficiency of turbine engines.

In a preferred form of embodiment of the invention, a number of small openings is disposed in a grid pattern in the shroud ring in the vicinity of the compression side of each turbine blade. As a result, the wall boundary layer is removed by suction over a relatively large surface area, whereupon the zones which have peripheral losses are reduced in size.

In an advantageous embodiment of the invention, the openings extend in the shroud ring in the radial direction. This disposition is attainable using the simplest possible means in terms of manufacturing techniques.

In an efficacious further development of the invention, guide vanes are disposed on the forward edges of the openings and inclined toward the rear edges thereof in the direction of rotation of the turbine blades. These guide vanes impart a tangential direction to the exhaust pulse, thus contributing further to an improvement in efficiency.

A further advantageous form of embodiment of the invention is distinguished in that the openings in the shroud ring are inclined toward the outside in a direction counter to the direction of rotation of the turbine blades. As a result of this provision, the disposition of the guide vanes, which are expensive in terms of manufacturing techniques, becomes superfluous, yet a similar effect which improves efficiency is attained.

Exemplary embodiments of the invention will now be described in detail, referring to the drawings.

BRIEF DESCRIPTION OF THE DRAWINGS

FIG. 1 is a partial section taken through a turbine rotor at right angles to the direction of the blades;

FIG. 2 is a partial section taken along the line II—II of FIG. 1; and

FIG. 3 is a partial section taken along the line III—III of FIG. 1.

DESCRIPTION OF THE PREFERRED EMBODIMENTS

Figure 4:
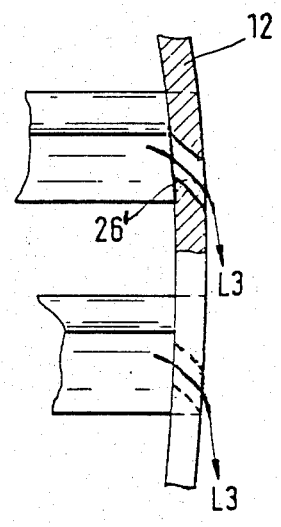
FIG. 4 is a partial section, corresponding to FIG. 3, of a modified embodiment.

As may be seen in FIG. 2, the outer end of a turbine blade 10, which is shown here in a view of the compression side, is closed off by a shroud ring 12 shown in cross section. A labyrinth seal, of which the sealing combs 16 and 18 are visible, is provided for effecting sealing between the housing 14 and the shroud ring 12. These sealing combs 16 and 18 divide the space of the labyrinth seal, which itself is divided from the blade channel by the shroud ring 12, into three chambers 20, 22 and 24. As shown more clearly in FIG. 2, these three chambers include a first chamber 20 on the upstream compression side of the blade, a second chamber 24 on the downstream side of the blade, and a third chamber 22 intermediate the first and second chambers. During operation it is substantially the static pressure $P_1$ of the turbine inlet which prevails in the chamber 20, which is located upstream preceding the sealing comb 16; and it is substantially the static pressure $P_2$ of the turbine outlet which prevails in the chamber 24 following the downstream sealing comb 18. When the turbine wheel is operated in this conventional manner, then a pressure which is between the two values $P_1$ and $P_2$ prevails in the chamber 22. The pressure drops at the sealing gaps between the sealing combs 16 and 18 and the shroud ring 12 produce the leakage flows $L_1$ and $L_2$, which are identical in magnitude. The gap loss is a result of these leakage flows.

Now when according to the invention an opening 26 is provided in the region of the shroud ring marked A in FIG. 1, which is located in the vicinity of the forward portion of the compression side of the blades (that is, substantially immediately beyond the first sealing ring 16, as shown more clearly in FIG. 2, for connecting the blade channel with the third intermediate chamber 22) and in which the pressure drop between the blade channel and the chamber 22 is the greatest. The medium which is braked in the wall boundary layer of the blade channel, and which would otherwise cause secondary losses in the blade channel, flows out through the opening 26 into the chamber 22. This results in an equalizing of the pressures before and after the sealing comb 16 located upstream, so that the leakage flow via the outer side of the shroud ring 12 is precluded. The medium blown into the chamber 22 passes through the gap at the sealing comb 18 located upstream, which is now located in a greater pressure drop, and back out of the labyrinth. The pressure compensation between the chambers 20 and 22 is attained if the overpressure prevailing in the region A is converted in the opening 26 into a flow velocity of the medium. To this end, the opening 26 must be dimensioned such that the exhaust quantity $L_3$ dictated by this flow velocity is equal to the leakage flow $L_2$ at the sealing comb 18 at the pressure difference of $P_1-P_2$. As a result, the leakage flow $L_1$ becomes zero; that is, no further medium is diverted away from the inlet side of the turbine wheel, so that the gap loss is eliminated.

In a different form of embodiment of the invention, in place of the opening 26 a plurality of small openings 28 may be distributed in a grid pattern over the region A of the shroud ring 12. As a result, the channel wall boundary layer is removed more uniformly by suction over a greater surface area, thereby reducing both turbulence in the chamber 22 and the size of the peripheral-loss zones.

In order to effect a further reduction of turbulence in the medium exhausted into the chamber 22, guide vanes 30 which are inclined toward the rear edges of the openings 26 may be disposed on the outside of the shroud ring 12 at the forward edges of the openings 26, as viewed in the direction of rotation of the turbine blades 10, these guide vanes 30 imparting a tangential direction to the exhaust pulse FIG. 3. A similar effect can be attained if the openings 26', 28' are disposed in the shroud ring 12 such that they are inclined from the inside toward the outside in a direction counter to the direction of rotation of the turbine blades 10 (FIG. 4).

The provisions according to the invention may be made either on the side of the shroud ring 12 of the rotor blades 10 toward the housing or on the rotor blade shroud ring toward the hub of the wheel.

What is claimed is:

1. In a rotor or guide wheel of a turbine engine having a turbine blade equipped with a shroud ring, wherein the engine has a labyrinth seal including at least two sealing combs (16,18) cooperating with the blade and forming three chambers, the first of which (20) is on the upstream compression side of the blade, the second of which (24) is on the downstream side of the blade, and the third of which (22) is intermediate the first and second chambers, the improvement which comprises at least one opening (26) provided in the shroud ring (12) in the vicinity of the upstream compression side (A) of each turbine blade (10) in a region defining a source of secondary leakage flow in which the pressure drop between the blade channel and the third chamber is greatest, and substantially immediately beyond the first sealing comb (16) for connecting the blade channel with the third chamber 22 between the sealing combs (16,18) of the labyrinth seal, whereby the pressures before and after the sealing comb (16) are substantially equalized, thereby minimizing the peripheral and gap losses.

2. The improvement as defined by claim 1, characterized in that a number of small openings (28) is disposed in a grid pattern in the shroud ring (12) in the vicinity of the compression side (A) of each turbine blade (10).

3. The improvement as defined by claim 1, characterized in that the openings (26 or 28) in the shroud ring (12) extend in the radial direction.

4. The improvement as defined by claim 1, characterized in that guide vanes (30) are disposed on the forward edges of the openings (26), inclined toward the rear edges thereof, viewed in the direction of rotation of the turbine blades (10).

5. The improvement as defined by claim 1, characterized in that the openings (26,28) in the shroud ring (12) are inclined from the inside toward the outside in a direction counter to the direction of rotation of the turbine blades (10).

* * * * *